US005946750A

United States Patent [19]

Shiu

[11] Patent Number: 5,946,750

[45] Date of Patent: Sep. 7, 1999

[54] SEPARABLE EXPANSION BED SHIELD SET

[76] Inventor: Ching-Gau Shiu, No. 5, Lane 258, Hopei 1st Rd., Shanmin Dist., Kaohsiung City, Taiwan

[21] Appl. No.: 09/088,110

[22] Filed: Jun. 1, 1998

[30] Foreign Application Priority Data

Jun. 4, 1997 [TW] Taiwan ..... 86209293

[51] Int. Cl.[6] ..... A47G 9/02; A47G 9/04

[52] U.S. Cl. ..... 5/502; 5/493

[58] Field of Search ..... 5/493, 499, 500, 5/502, 482, 484, 497

[56] References Cited

U.S. PATENT DOCUMENTS

| | | | |
|---|---|---|---|
| 3,290,702 | 12/1966 | Seltzer | 5/497 |
| 3,789,441 | 2/1974 | Weiss | 5/497 |
| 5,042,099 | 8/1991 | Brenner et al. | 5/493 |
| 5,063,626 | 11/1991 | Carlos | 5/493 |
| 5,205,003 | 4/1993 | Green | 5/493 |

FOREIGN PATENT DOCUMENTS

| | | | |
|---|---|---|---|
| 2800586 | 7/1979 | Germany | 5/497 |

*Primary Examiner*—Alexander Grosz
*Attorney, Agent, or Firm*—Bacon & Thomas PLLC

[57] ABSTRACT

A separable expansion bed shield set comprising a face fabric (4), a fall (10), a cotton fabric (5), an interliner (8), a base fabric (6) and an expansion fabric (7) wherein said fall (10) is either attached to or separate from said face fabric (4), said interliner (8) is contained in and attached to said base fabric (6), said expansion fabric is stretched to the same size as that of said face fabric (4) and base fabric (6) to be sewn into a bed shield applicable to various sizes of mattresses, and said expansion fabric (7) is provided between said cotton fabric (5) and base fabric (6).

3 Claims, 6 Drawing Sheets

SEPARABLE EXPANSION BED SHIELD SET

BACKGROUND OF THE INVENTION

There are four sizes of bed shields available in the current market. These are Standard 5'×6.2', Extra 6×6.2', Modern 5.8'×6.7' and King Size 6'×7'. All these bed shields have to be separately sewn and made depending on the size of the corresponding mattress. Interchanging among bed shields of different sizes is prevented as the household bed mattresses come in different sizes and the consumer must designate the size of mattress when buying the matching bed shield.

Once the bed shield is contaminated, such as by children's urine, the mattress inside is also affected by the seepage of urine which generates a smell. Both the bed shield and bed mattress need to be washed to clean. Furthermore, although the bed mattress of the prior art may be covered with a plastic film, the plastic film not only causes noise but also makes people sleeping upon it very uncomfortable. Eventually, such plastic film is usually removed from the mattress in practical use.

There is a need for a bed shield which fits different size mattresses and that is simple and inexpensive to produce.

SUMMARY OF THE INVENTION

The present invention relates to a separable expansion bed shield set by providing between a base fabric and a cotton fabric an expansion lining fabric which is comparatively smaller in size than the base fabric and cotton fabric. The lining fabric when stretched out will have the same size as that of the base fabric and is sewn to the base fabric in a stretched condition. Since both the base fabric and the lining fabric are respectively cut to the larger size, the bed shield of the present invention can be used for any size of mattress available in the market and interchangeable among different sizes of mattress while retaining the comfort expected from the bed shield. Furthermore, the present invention may be applied in conjunction with an interliner and a separated fall.

DESCRIPTION OF THE PREFERRED EMBODIMENTS

Figure 1:
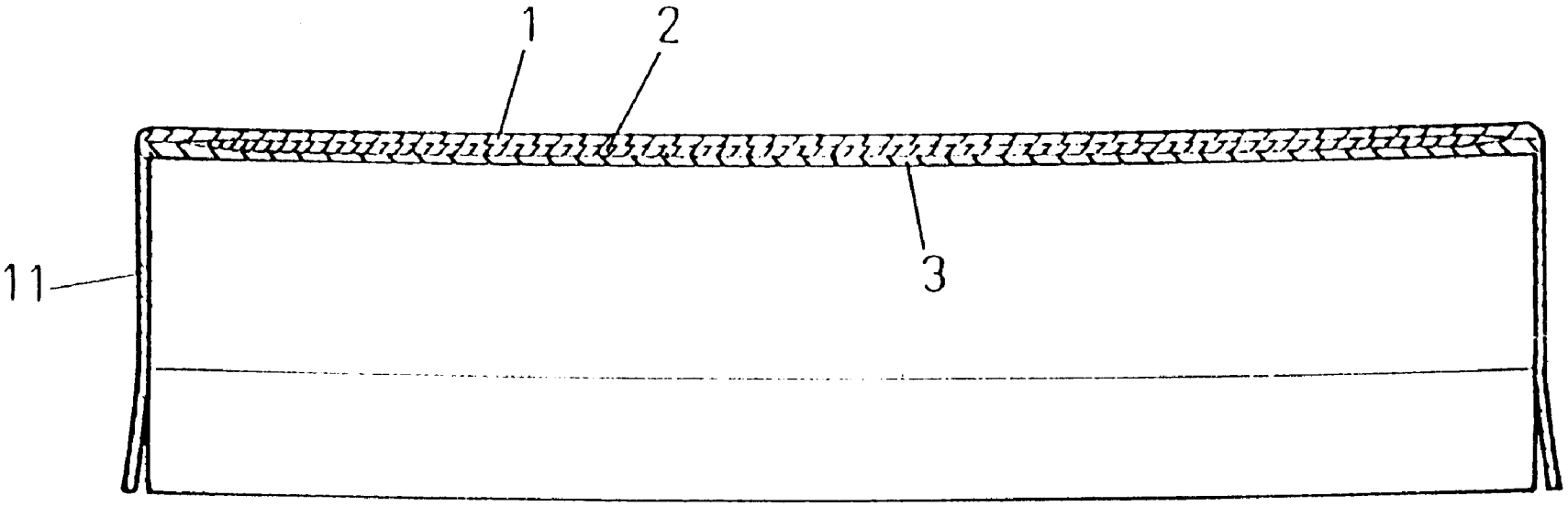
FIG. 1 PRIOR ART
FIG. 1 is a schematic drawing of bed shield elements according to the prior art.

Referring to FIG. 1, a bed shield according to the prior art, is shown. This bed shield comprises a face fabric 1, a cotton fabric 2 and a base fabric 3. The cotton fabric 2 is sewn between the face fabric 1 and base fabric 3 to provide warmth and comfort for the person sleeping on the bed. Furthermore, a fall 11 is sewn outside the face fabric 1 to fend the lower base of bed panel underneath a mattress. To match the size of a particular size of mattress available in the market, the fabrics must be separately cut in size to match the mattress before being sewn together.

Figure 2:
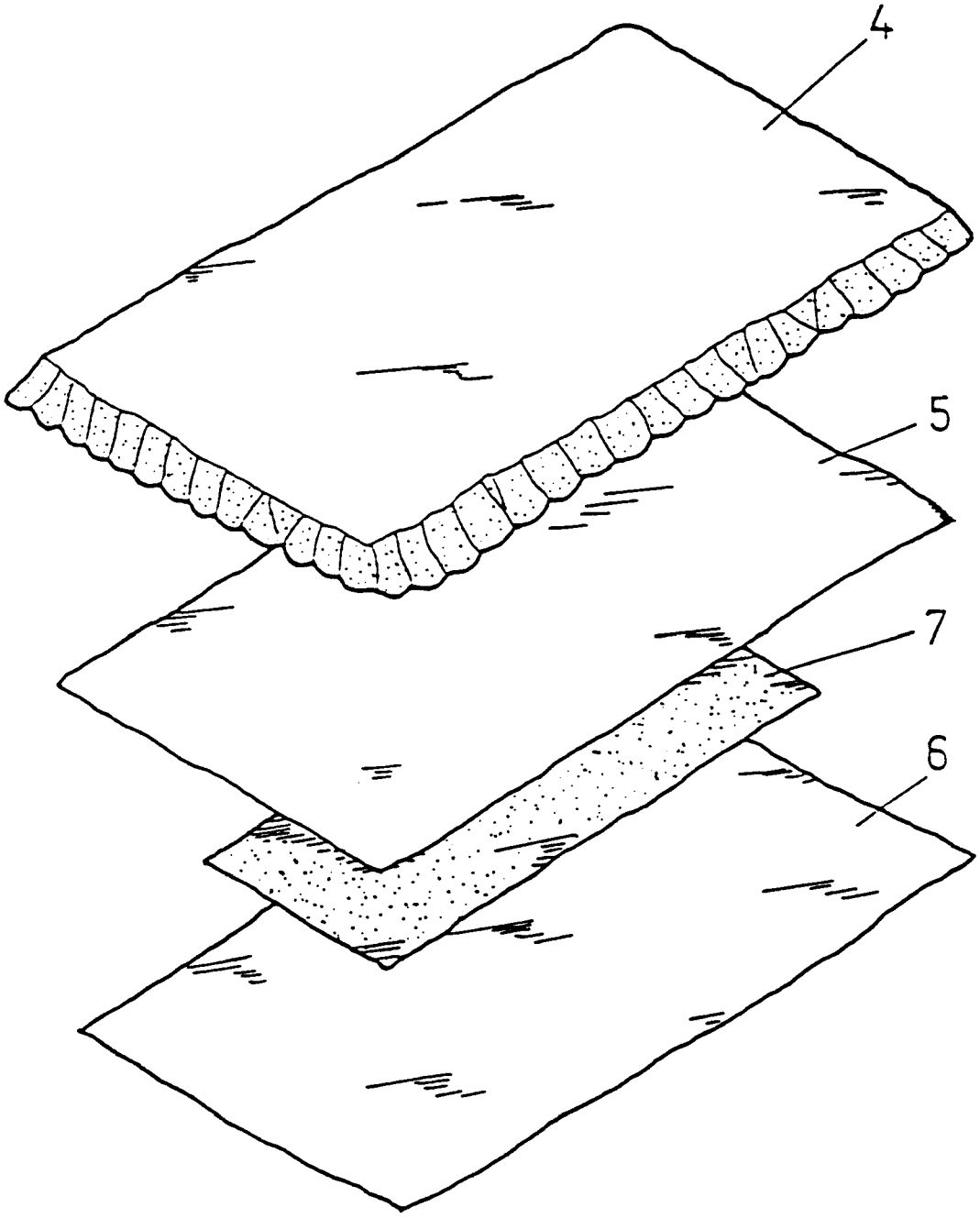
FIG. 2 is a perspective view of key elements of the present invention.
Figure 3:
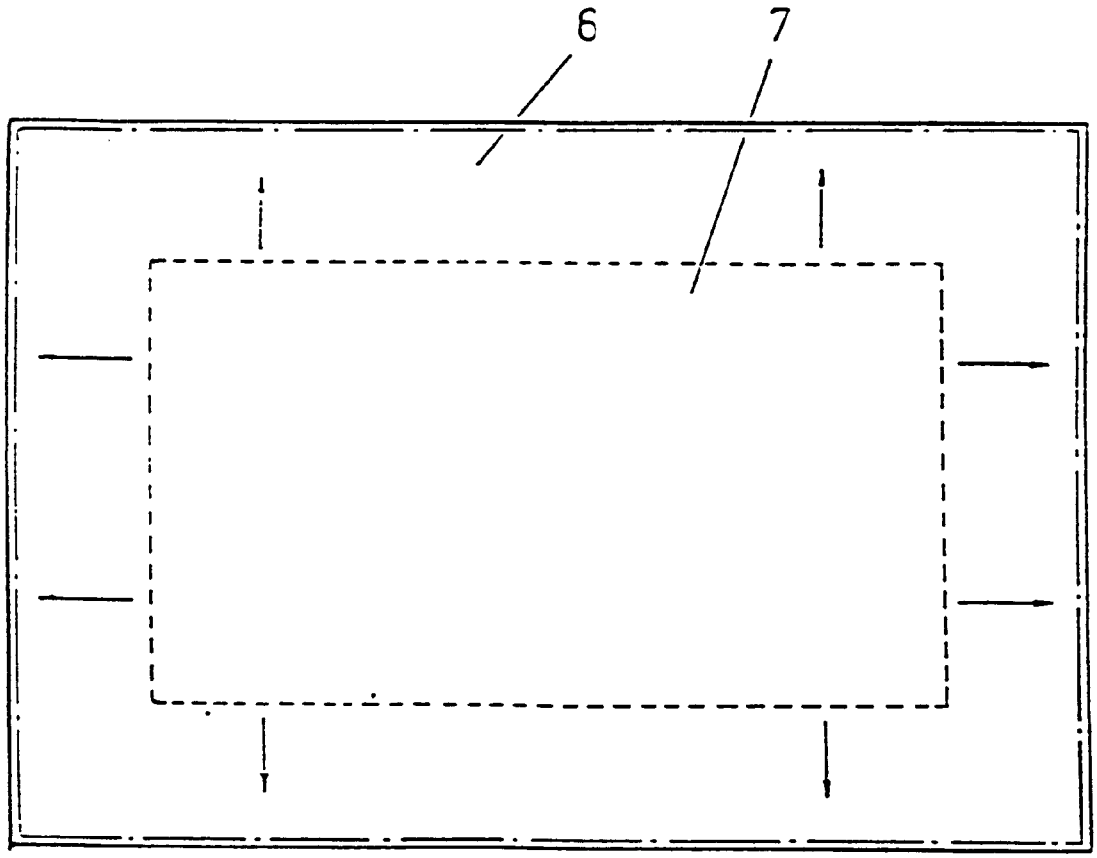
FIG. 3 is a schematic drawing of the spread expansion lining of the present invention.

Referring to FIG. 2, a separable expansion bed shield set according to the present invention is shown and which generally comprises a face fabric 4, a cotton fabric 5, a base fabric 6 of given size and an expansion lining 7 which is comparatively smaller in size than that of the base fabric 6. The size respectively of the base fabric, face fabric and cotton fabric is equivalent to that of the king size mattress while the size of the expansion lining 7 is equivalent to that of the standard mattress. The expansion lining 7, allowing an expansion amount approximately 25% from the original size, is cut from a known bidirectional expansion fabric. According to the present invention, the expansion lining 7 is provided between the cotton fabric 5 and the base fabric 6. That is, the face fabric 4, the cotton fabric 5, the expansion fabric 7 and the base fabric are overlapped from top in sequence to be sewn to the peripheral to become the bed shield. When put on top of the base fabric 6, the expansion lining (7) must be extended at its peripheral to match the size of the base fabric 6 and sewn to become the bed shield as illustrated in FIG. 3. The retraction force of the expansion lining 7, reduces the size of the bed shield to the same size as that of the expansion lining before its expansion. The bed shield is able to be expanded to the original size of the base fabric 6.

Figure 4:
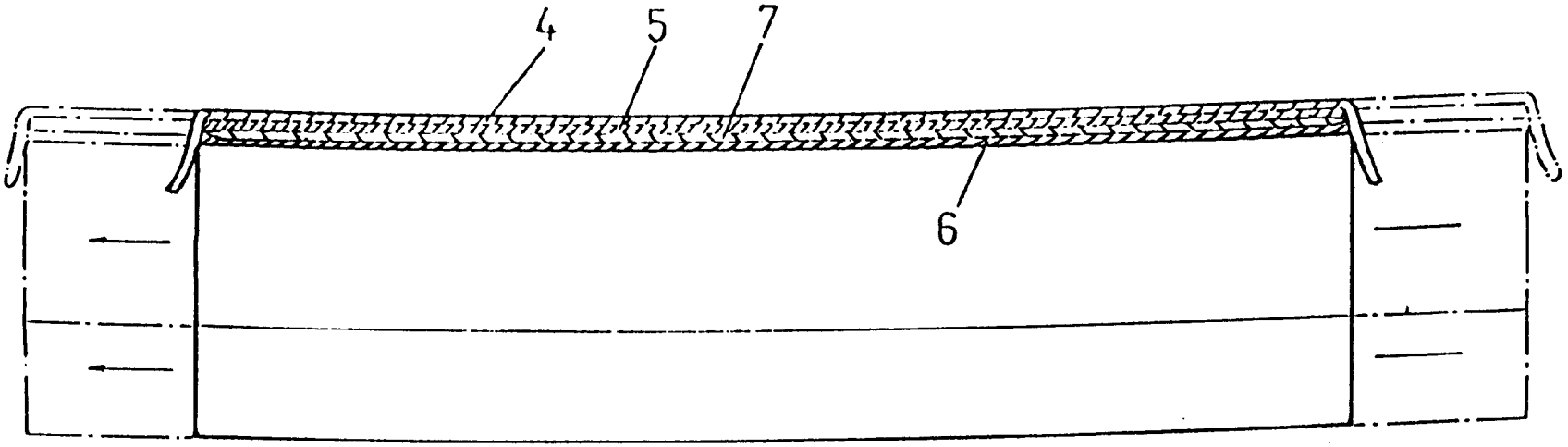
FIG. 4 is a schematic drawing of spread bed shield of the present invention.

The bed shield set according to the present invention is suitable to cover up the standard mattress because the expansion lining 7 is cut in the size identical to the standard mattress of the smallest size available in the market. The king size mattress is approximately 15–20% larger than that of the standard mattress. Therefore, by the expansion amount of approximately 25% of the expansion fabric 7 and the fitting of the king size mattress by the face fabric 4, cotton fabric 5 and base fabric 6, the bed shield of the present invention can be stretched depending on any size of the mattress available in the market according to the embodiment as illustrated in FIG. 4. Furthermore, the expansion fabric 7 according to the present invention is placed beneath the cotton fabric 5 which still functions as the padding fabric and the comfort of a person sleeping on the bed shield will not be affected. The construction of the present invention will not cause a major increase in the production cost and the manufacturing process is no more complicated than that of the prior art. The present invention is feasible for an economic scale of production.

Figure 5:
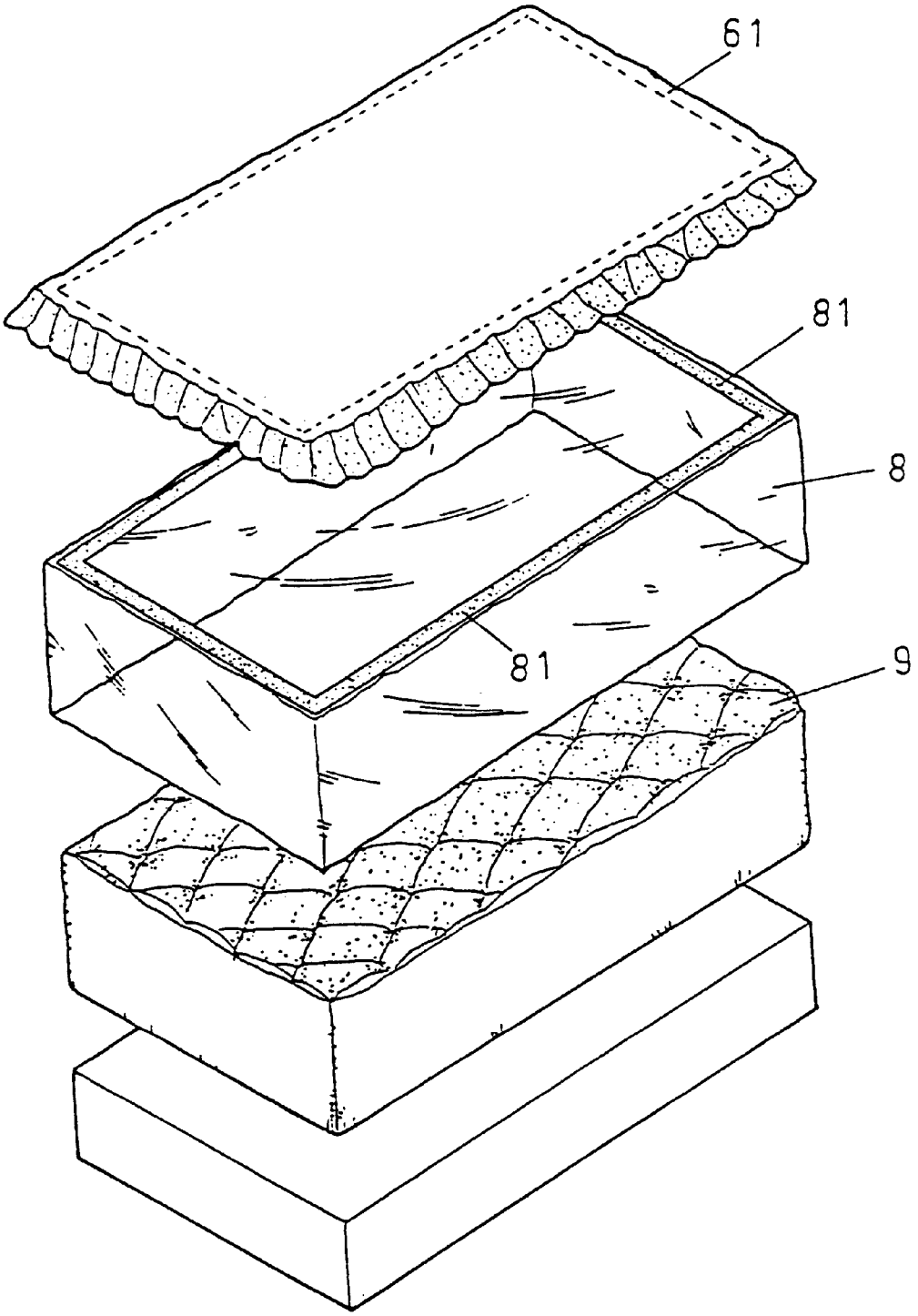
FIG. 5 Is a schematic drawing of an embodiment of the present invention with interliner.

FIG. 5 illustrates another preferred embodiment of the present invention, wherein an interliner 8 is attached beneath the base fabric 6 and an adhesive tape 61 is sewn to the peripheral below the base fabric to be attached with the interliner 8 for covering over a mattress 9. According to the present invention, the interliner 8 made of water-proof and air permeable fabric covers the top of the mattress 9, and adhesive tape 81 is sewn to the peripheral above the interliner 8 thus to avoid the use of a fastening element (expansion belt) of the prior art. Instead, the adhesive tape 61 below the base fabric attaches to the corresponding adhesive tape 81 from the interliner 8. The preferred embodiment allows easy replacement of the bed shield for laundry and any seepage of contamination such as urine will not penetrate into the mattress 9 since the interliner 8 is sufficient to stop the contamination from seeping through and entering the mattress 9. The contaminated mattress 9 will not develop smells, and requires only wiping to clean without the necessity of having it washed to clean and dried out. The interliner 8 is provided beneath the bed shield and will not affect the comfort of a person sleeping on the mattress 9.

Figure 6:
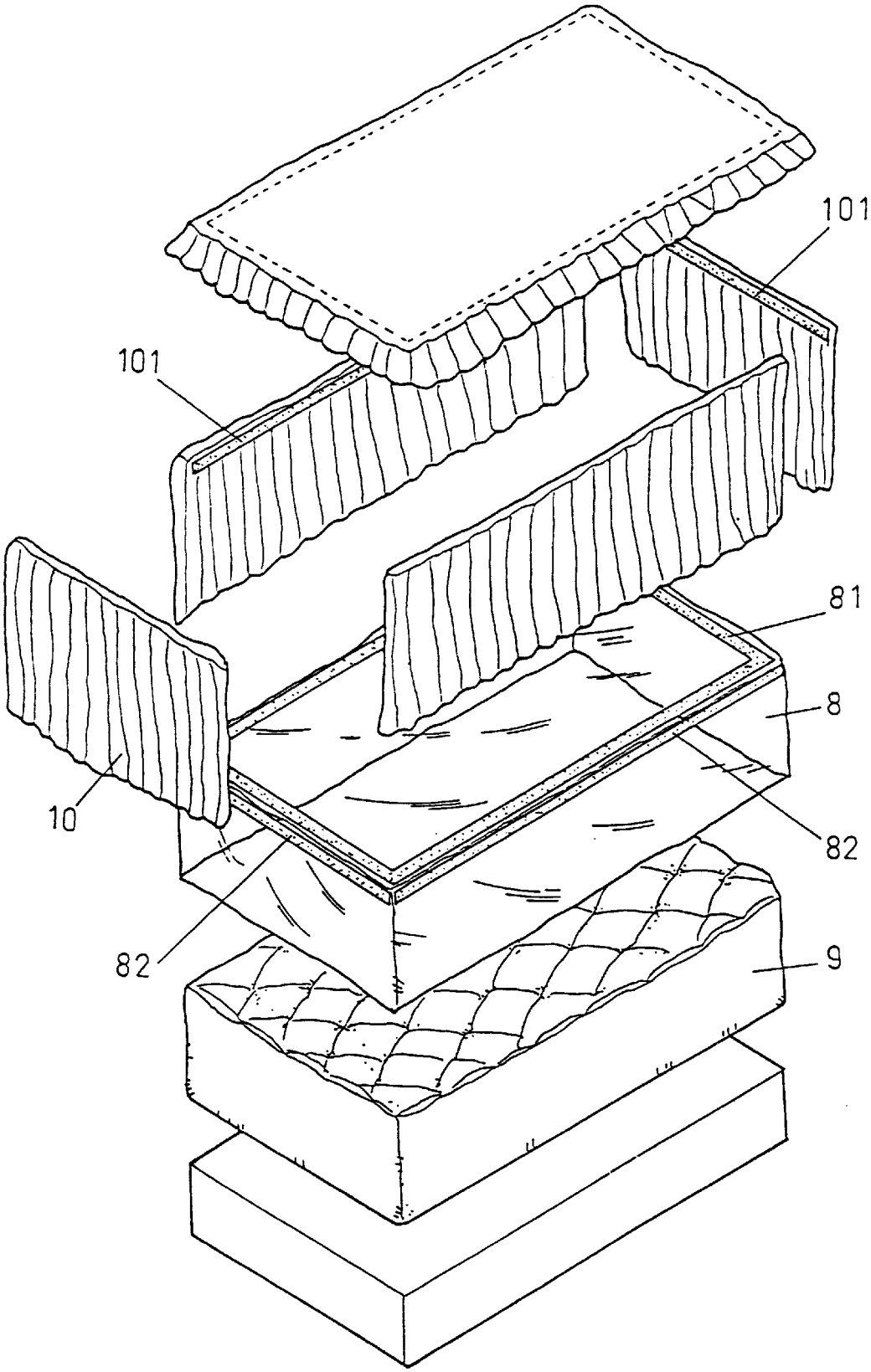
FIG. 6 is a schematic drawing of another embodiment of the present invention with interliner and separated fall.

A conventional fall can be sewn to the face fabric 4 of the present invention to cover up the base bed panel. However, to make the present invention even more practical in use, another preferred embodiment is illustrated in FIG. 6. In this embodiment, an adhesive tape 82 is provided to the peripheral of the interliner 8. A fall 10 which is separable from the bed shield is an independent piece. An adhesive tape 101 is sewn to the upper edge of the fall 10 so that the fall 10 can be engaged to the adhesive tape 82 sewn on the peripheral of the interliner 8 for covering up the base bed panel. Therefore, when any fall 10 or the bed shield requires laundry, the fall 10 may be removed by piece for laundry without the bed shield.

As indicated, by using the face fabric that is detachable from the fall, the cotton fabric, the base fabric containing the interliner attached below and the expansion fabric in smaller size provided between the base fabric and the cotton fabric allows the bed shield of one size to be interchangeable among various sizes of mattress. Other advantages of the present invention include the feature that the fall and the mattress can be separately removed for laundry, and that the contamination will not penetrate into the mattress.

What is claimed is:

1. A separable expansion bed shield set comprising a face fabric (4), a cotton fabric (5), a base fabric (6) and an expansion fabric (7) wherein said expansion fabric in its unstretched state is dimensionally smaller in size than the face fabric (4), the cotton fabric (5), and the base fabric (6) and is stretched to the same size as that of the face fabric (4) and base fabric (6), and sewn into a bed shield applicable to various sizes of mattress and wherein said expansion fabric (7) is provided between said cotton fabric (5) and said base fabric (6).

2. A separable expansion bed shield set according to claim 1 wherein a waterproof and air permeable interliner (8), for protection of a mattress, is provided under the base fabric (6), an adhesive tape (81) is respectively provided on top and in the peripheral of said interliner (8), said adhesive tape (81) is also provided to the peripheral of the bottom to said base fabric (6) to attach the base fabric (6) at the bottom of the bed shield and cover up said interliner (8).

3. A separable expansion bed shield set as claimed in claim 2 having a fall (10) of the bed shield which is separable as an independent sheet, and wherein adhesive tape (101) is sewn near the top of said fall (10) to attach it to the peripheral of said interliner(8).

* * * * *